US005529000A

United States Patent [19]

Hartel et al.

[11] Patent Number: 5,529,000

[45] Date of Patent: Jun. 25, 1996

[54] PULVERIZED COAL AND AIR FLOW SPREADER

[75] Inventors: Edward O. Hartel, Orange, Conn.; Brian W. Doyle, Newberg, Oreg.; John F. Hurley, Easton, Conn.; Dan V. Giovanni, Berkeley, Calif.

[73] Assignees: Combustion Components Associates, Inc., Monroe, Conn.; Electric Power Technologies, Inc., Menlo Park, Calif.

[21] Appl. No.: 288,740

[22] Filed: Aug. 8, 1994

[51] Int. Cl.[6] ..... F23D 1/00

[52] U.S. Cl. ..... 110/347; 110/104 B; 110/261; 110/264; 431/183

[58] Field of Search ..... 110/261, 264, 110/265, 104 R, 104 B, 341, 347, 263; 431/181, 182, 183, 184; 239/501, 502, 503

[56] References Cited

U.S. PATENT DOCUMENTS

| | | | |
|---|---|---|---|
| 1,959,521 | 5/1934 | Bolt | 158/1.5 |
| 2,087,869 | 7/1937 | Blodgett | 110/104 |
| 3,048,131 | 8/1962 | Hardgrove | 110/72 |
| 3,195,872 | 7/1965 | Schneider et al. | 263/19 |
| 3,694,135 | 9/1972 | Dancy et al. | 431/265 |
| 4,223,615 | 9/1980 | Breen et al. | 110/264 |
| 4,457,241 | 7/1984 | Itse et al. | 110/347 |
| 4,654,001 | 3/1987 | LaRue | 431/354 |
| 4,681,532 | 7/1987 | Chung | 431/183 |
| 4,790,480 | 12/1988 | Rennie | 239/125 |

OTHER PUBLICATIONS

Principles of Combustion Engineering For Boilers, Academic Press 1987, Chapter Three, The Combustion of Coal as Pulverized Fuel through Swirl Burners by T. F. Wall, pp. 319–327.

Internal Fuel Staging in Low $NO_x$ Burner Designs by J. W. Allen & P. R. Beal, The American Society of Mechanical Engineers, Paper 91–JPGC–FACT–4 Presented at the International Power Generation Conference, Oct. 6–10, 1991, San Diego, CA pp. 1–8.

*Primary Examiner*—Henry A. Bennett
*Assistant Examiner*—Susanne Tinker

[57] ABSTRACT

Pulverized coal and air flowing-in a coal nozzle are distributed for combustion with low NOX generation by a concentric central duct with long exterior spiraling vanes which extend upstream and attach to a support pipe extending further upstream in the nozzle. The space from the downstream end of the support pipe to the upstream end of the central duct, and the cross section of the pipe relative to the cross section of the central duct regulate the entry of coal and air into the central duct from which the flow emerges with reduced velocity as a central stream stabilizing the flame. The central duct also has an exterior short vane attached to each long vane to separate the pulverized fuel and air outerflow into fuel-enriched swirling streams and fuel-depleted recirculation zones.

20 Claims, 2 Drawing Sheets

PULVERIZED COAL AND AIR FLOW SPREADER

FIELD OF THE INVENTION

Figure 1:
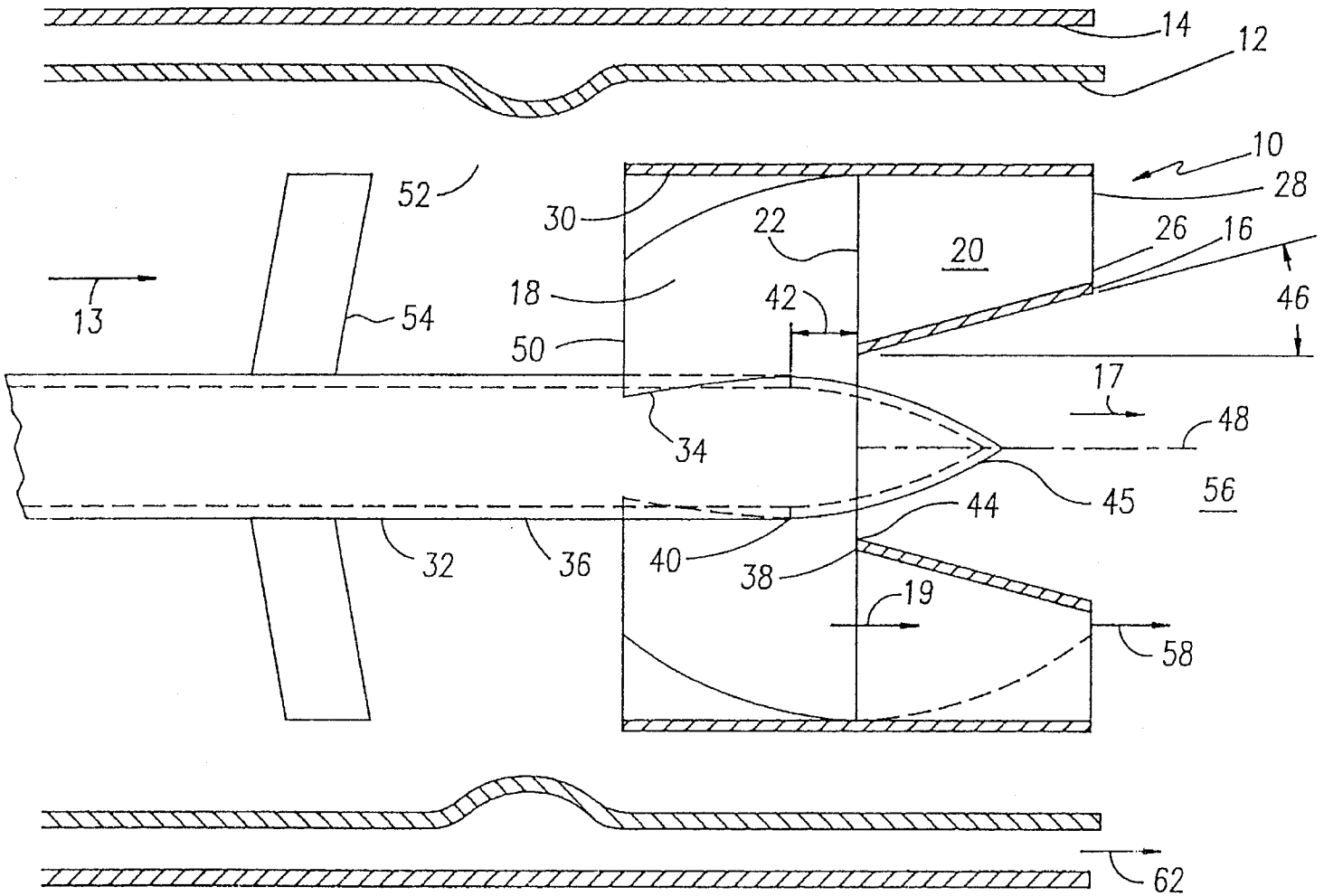

This invention relates to an apparatus and method for distributing pulverized fuel and air flow from a burner nozzle for combustion with reduced emission of oxides of nitrogen.

BACKGROUND

Large consumers of fossil fuels are required to meet emission standards which become stricter as time progresses. Among the pollutants that must be controlled are oxides of nitrogen collectively referred to as NOX. New installations of boilers and furnaces are designed to provide reduced emission of such pollutants. However, existing large, pulverized coal fired boilers and furnaces are difficult to modify economically to yield tolerable pollutant levels, particularly when subjected to appreciable load variations.

What is needed is a device that will alter the combustion in existing installations such that NOX pollutants are reduced. The device desirably will be readily introducible into existing coal nozzles, will provide a flowing mixture which is readily ignitable, and will operate in a stable manner over a wide range of load variations.

SUMMARY

The present invention is directed to an apparatus and method of distribution of air and pulverized coal for combustion that satisfies the above needs. The apparatus is a spreader for dispersing a flow of air and pulverized coal within a coal nozzle. The spreader comprises a central duct for dividing a flow of air and pulverized coal into a central stream within the central duct and into an outer flow surrounding the central duct. At least one long vane extends outwardly from the central duct and generally spirally downstream along the central duct.

For each long vane, a corresponding short vane extends outwardly from the central duct. The upstream end of the short vane originates in an intersection with the long vane and extends downstream divergently from the long vane. The short vane and long vane divide the outer flow into at least two outer streams separated by at least one recirculation zone and direct the outer streams to flow spirally or swirl around the central stream. The vanes deflect pulverized coal toward the outer streams and away from the recirculation zones. Fuel and air staging is thus accomplished thereby lowering NOX generation.

Each long vane extends upstream of the central duct, and along its innermost radius attaches to a support pipe which is preferably concentric with the coal nozzle. The downstream end of the support pipe is preferably spaced from the upstream end of the central duct, and the cross sectional area of the support pipe is preferably not greater than the cross sectional area of the central duct at its upstream end. The support pipe obstructs and controls the entry of pulverized coal and air from the coal nozzle into the central duct. The flow within the central duct, namely the central stream, is slowed as it expands to fill the cross section of the central duct. Preferably the central duct expands in cross section in the downstream direction further reducing the velocity of the central stream. Preferably the velocity of the central stream is adjusted such that ignition is readily accomplished, the resulting flame is stable, and flashback does not occur.

This invention also provides a method of spreading a flow of air and pulverized coal within a coal nozzle into streams for staged combustion. The method comprises: dividing a flow of air and pulverized coal into a central stream and a surrounding outerflow; dividing the outer flow into at least two outer streams separated by recirculation zones; and causing the outer streams to flow spirally or swirl around the central stream. The outer streams diverge from the coal nozzle centerline downstream of the spreader. The method further comprises expanding the cross section of the central stream. The method also further comprises encompassing the outer streams with a flow of secondary air for combustion.

DRAWINGS

Figure 2:
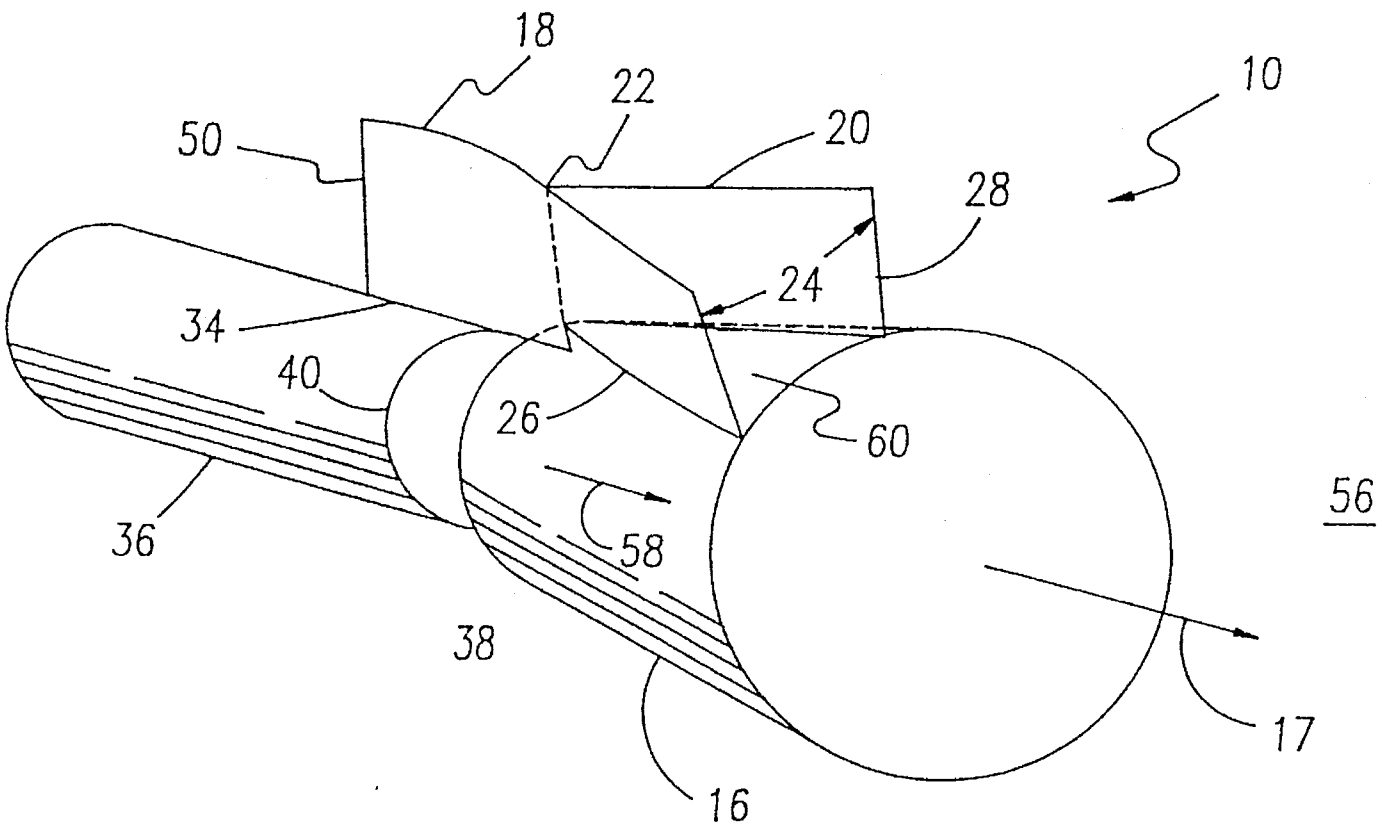

These and other features, aspects and advantages of the present invention will become better understood with reference to the following description, appended claims and accompanying drawings where:

FIG. 1 is an elevation view of the invention as installed in a coal nozzle shown in section; and FIG. 2 is an elevation view of the invention in perspective.

DESCRIPTION

In the exemplary embodiment of the invention disclosed in FIG. 1 and FIG. 2, a spreader 10 for pulverized coal is positioned within and at the end of a duct which forms a coal nozzle 12. Within the coal nozzle 12, from left to right, is a flow 13 of pulverized coal carried by primary air for combustion. Encompassing the coal nozzle 12 is a secondary air barrel 14 forming an annulus within which flows secondary air 62 for combustion.

The spreader 10 comprises a central duct 16 which preferably is positioned concentrically within the end of the coal nozzle 12. Typically at the upstream end 38 of the central duct, the central duct cross section is from about 3% to about 30% of the coal nozzle cross sectional area, preferably from about 5% to about 15%. The central duct 16 divides the flow 13 of pulverized coal and air in the coal nozzle 12 into a central stream 17 within the central duct 16 and an outer flow 19 surrounding the central duct. At least one long vane 18 extends outwardly from the central duct 16 and spirals downstream along the exterior of the central duct. Two long vanes are visible in FIG. 1 and only one is shown in FIG. 2. A spreader has at least one, but preferably from three to eight long vanes.

For each long vane 18, a corresponding short vane 20 extends outwardly from the central duct. The upstream end of the short vane originates in an intersection 22 with the long vane 18 and extends downstream divergently from the long vane. At the intersection 22, the long and short vanes diverge downstream at an angle 24 of from about 10 degrees to about 60 degrees, preferably at a angle 24 of from about 20 degrees to about 45 degrees. The downstream end 26 of either the long vane or the downstream end 28 of the short vane, whichever extends least downstream, defines an annular cross section which is obscured from about 20% to about 80% by the vanes, preferably from about 25% to about 50%. The outer radial extremity of the vanes may have a circumferential outer shroud 30 encompassing a portion, or the entire length, of each long or short vane. Desirably the outer radial extremities of the vanes, or the outer extremity of the optional shroud, approach the inside of the coal nozzle, but clearance is acceptable in order to allow the spreader to be inserted from the upstream end of the coal nozzle through any reduced cross section in the coal nozzle.

Each long vane 18 extends upstream of the central duct 16 and attaches to a support pipe 32 which is preferably concentric with the coal nozzle 12. The attachment is along an intersection 34 formed by the innermost radius of each long vane 18 and the outside surface of the pipe. The outside cross sectional area 36 of the pipe 32 is preferably not greater than the inside cross sectional area at the upstream end 38 of the central duct 16. The support pipe 32 provides a flow obstruction upstream of, or at, the upstream end 38 of the central duct to the entry of air and pulverized coal into the upstream end of the central duct, and thus influences the amount of pulverized coal and air flow entering the central duct. The obstruction preferably has a cross sectional area in the range of from about 20% to about 80% of the cross sectional area of the upstream end 38 of the central duct, most preferably from about 50% to about 70%.

The downstream end 40 of the support pipe may terminate upstream of the upstream end 38 of the central duct or may extend into the central duct 16. Pulverized coal and air from the coal nozzle 12 to some extent enter the central duct 16 through the space 42 between the downstream end 40 of the support pipe and the upstream end 38 of the central duct. Thus the space 42 also influences the amount of pulverized coal and air flow entering the central duct. In terms of the inside diameter 44 at the upstream end 38 of the central duct, the space 42 from the downstream end 40 of the support pipe is from about zero to about one diameter from the upstream end 38 of the central duct, preferably from about 0.2 to 0.5 diameters.

Optionally, to the downstream end 40 of the support pipe, there may be attached a tapered centerbody 45, which will provide controlled diffusion and pressure recovery for the central stream 17. The centerbody 45 may be a cone or a more complex curved surface, such as an ellipsoidal or paraboloidal surface.

The central duct 16 may be supported by alternate means, such as struts extending from the central duct to the coal nozzle (not shown). An obstruction to the upstream end 38 of the central duct may be provided by an object other than a pipe at or upstream of the upstream end of the central duct. The object (not shown) may, for example, be a sphere, an ellipsoid, a plate, or a perforated plate.

The central duct 16 may have a portion with cross sectional area constant along its length, or with cross sectional area decreasing or increasing along its length. Preferably the cross sectional area of the central duct increases in the downstream direction. Thus preferably the central duct 16 may have a wall portion which diverges in a downstream direction at an angle 46 from the longitudinal axis 48 of the central duct of from about 0 degrees to about 50 degrees, most preferably from about 10 degrees to about 30 degrees.

The spreader vanes desirably are constructed of metal resistant to high temperature and corrosion. The upstream edges 40 of the long vanes are preferably coated with an abrasion-resistant material for resisting abrasion by the pulverized coal flow. A preferred coating material comprises a ferrous alloy with a high chromium content, typically from about 15% to about 25% chromium by weight, most preferably about 20% chromium. The alloy may be applied to the spreader vanes by common welding techniques.

The spreader 10 may be positioned in a coal nozzle 12 which has a contraction or venturi. The upstream wall of the venturi, that is, the contraction portion 52, may be used to deflect the pulverized coal towards inner annuli of the coal and air flow, that is, towards the center of the coal nozzle. The coal nozzle 12 may also contain a set of swirl vanes 54 upstream of the spreader 10 which may be used to swirl the pulverized coal towards outer annuli of the air and pulverized coal flow, that is, away from the center of the coal nozzle. The distance between the swirl vanes and the spreader influences the degree of concentration of the coal towards the wall of the nozzle. These geometric parameters in conjunction with other parameters are used to achieve optimum performance with the spreader.

In operation, a pulverized coal and air flow 13 is established in the coal nozzle. A portion of the pulverized coal and air flow in the coal nozzle enters the upstream end 38 of the central duct 16, the degree of obstruction of the upstream end controlling the portion entering which is termed the central stream 17. Within the central duct 16, the central stream 17 expands to fill the cross section available in the central duct and is thereby slowed in velocity. The central stream 17 in the central duct is further slowed in velocity by any downstream expansion in the cross section of the central duct. The central stream 17 emerges from the central duct 16 at reduced velocity into the combustion zone 56. The reduced velocity of the central stream 17 permits pilot flame retention for enhanced flame stability over wide load ranges. The obstructed inlet of the central duct and the expanding cross sectional area of the central duct allow the emerging velocity of the central stream into the combustion zone to be adjusted such that ignition is readily accomplished, the flame is stable and is not blown out, and flashback does not occur. Installing an optional centerbody 45 further enhances flame stability.

The description continues assuming, for clarity, that more than one long vane 18 is present in the spreader. Most of the flow in the coal nozzle outside the central duct, namely the outer flow 19, enters the channels formed by the long vanes. A portion of the flow in the coal nozzle may bypass the spreader vanes through any clearance space between the outer extremity of the spreader vanes 18 and the coal nozzle 12 without substantial adverse effect. The long vanes 18 direct the outer flow 19 in the vane channels to spiral around the central duct 16. In the vane channels, each short vane 20 in combination with a corresponding long vane 18 creates a flow obstruction downstream of which exists a wake or recirculation zone 60. Thus the outer flow 19 emerges with swirl from each pair of spreader vanes 18, 20 divided into streams 58, each pair of which is separated by a wake or recirculation zone 60 which exists downstream of the obstruction created by each pair of vanes. As the outer flow passes through the vanes, each pair of diverging vanes deflects the flow of air and coal so as to reduce the concentration of fuel in the recirculation zone 60 immediately downstream of the obstruction created by each pair of diverging vanes, thus producing a fuel-depleted zone. In these recirculation zones 60, air and coal flow is largely replaced by recirculating combustion gases.

Correspondingly, the concentration of coal is increased by the vanes in the streams 58 adjacent to the recirculation zones 60, creating fuel-enriched zones. In these fuel-enriched zones, the increased concentration of coal causes slow fuel-rich combustion which serves to reduce the formation of NOX.

The outer streams 58 directed spirally around the central stream 17 are higher in velocity than the central stream 17. The swirl and higher velocity expand the flame allowing controlled mixing of the fuel and air, reduced temperatures, and time for more complete combustion. The alternate fuel-enriched and fuel-depleted conditions created respectively in the outer streams 58 and interposed recirculation zones 60 serve to stage admission of fuel to combustion air and lower combustion flame temperature, thereby repressing the formation of NOX.

Downstream of the vanes 18, 20, in the combustion zone 56, the swirling streams 58 and the recirculation zones 60 preferably are encompassed by a flow of secondary air 62 for combustion. The flow of secondary air 62 emerging from the secondary air barrel 14 encompasses the outer streams and recirculation zones and mixes in at moderate rates which also serves to repress the formation of NOX. Optionally, swirl vanes may be provided in the secondary air barrel to help expand the secondary air flow. Complete mixing of fuel and secondary air is delayed and staged by the segmentation of the flow and stratification induced by the spreader. By selecting the number of vanes and physical dimensions of the spreader to suit the application geometry and flow conditions, the invention provides complete mixing and complete combustion at a sufficient distance from the coal nozzle exit so that NOX formation is suppressed.

The described spreader is an inexpensive apparatus which may be readily incorporated into existing burners without substantial installation cost, and provides a low cost alternative to burner modification. The support pipe and the structure on its end may be introduced from and readily supported at the upstream end of a coal nozzle. Since the spreader has no moving parts and can be fabricated from high temperature alloy of substantial thickness, little or no maintenance is required on the spreader other than its occasional repair or replacement for abrasion and oxidation.

Although the present invention has been described in considerable detail with reference to certain preferred versions thereof, other versions are possible. Therefore, the spirit and scope of the appended claims should not be limited to the description of the preferred versions contained herein.

What is claimed is:

1. A spreader for spreading a flow of air and pulverized coal into streams for staged combustion, said spreader comprising:

(a) a central duct for dividing a flow of air and pulverized coal into a central stream within said central duct and into an outer flow surrounding said central duct;

(b) at least one long vane extending outwardly from said central duct and generally spirally downstream along said central duct;

(c) at least one short vane extending outwardly from said central duct, said short vane forming an intersection with said long vane and therefrom extending downstream divergently from said long vane;

said at least one short vane and long vane for dividing the outer flow into at least two outer streams separated by at least one recirculation zone and directing the outer streams to flow spirally around the central stream.

2. The spreader as in claim 1 wherein said spreader is for spreading a flow of air and pulverized coal within a coal nozzle, said central duct has an upstream end, said coal nozzle has a cross sectional area at said upstream end of said central duct, and said central duct has a cross sectional area at said upstream end of said central duct of from about 3% to about 30% of said coal nozzle cross sectional area.

3. The spreader as in claim 1 wherein said central duct has an upstream end having a cross sectional area and said spreader further comprises a flow obstruction near said upstream end, said flow obstruction for obstructing entry of air and pulverized coal flow into said cross sectional area at said upstream end of said central duct.

4. The spreader as in claim 3 wherein said flow obstruction has a cross sectional area ranging from about 20% to about 80% of said cross sectional area of said upstream end of said central duct.

5. The spreader as in claim 1 wherein said central duct has a longitudinal axis and a wall portion which diverges in a downstream direction at an angle from the longitudinal axis of from about zero degrees to about 50 degrees.

6. The spreader as in claim 1 wherein said central duct has a longitudinal axis and a wall portion which is circular in cross section and which diverges in a downstream direction at an angle from the longitudinal axis of from about 10 degrees to about 30 degrees.

7. The spreader as in claim 1 wherein said long and short vanes each have a downstream end, and the end of whichever vane extends leastward downstream defines for pulverized coal and air flow an annular cross section which is obscured from about 20% to about 80% by said vanes.

8. The spreader as in claim 1 further comprising an outer shroud integral with and encompassing at least a portion of said at least one long vane.

9. The spreader as in claim 1 wherein at least one upstream edge of said vanes is covered with an abrasion-resistant material comprising a ferrous alloy with from about 15% to about 25% chromium content.

10. A method of spreading a flow of air and pulverized coal into streams for staged combustion, said method comprising:

(a) dividing a flow of air and pulverized coal into a central stream and a surrounding outer flow;

(b) dividing said outer flow into at least two outer streams separated by recirculation zones; and (c) causing said at least two outer streams to flow spirally around said central stream.

11. The method as in claim 10 further comprising expanding in cross section said central stream subsequent to step (a).

12. The method as in claim 10 further comprising a subsequent step of encompassing said at least two outer streams with a flow of secondary air for combustion.

13. A spreader for spreading a flow of air and pulverized coal into streams for staged combustion, said spreader comprising:

(a) a central duct for dividing a flow of air and pulverized coal into a central stream within said central duct and into an outer flow surrounding said central duct;

(b) a support pipe upstream and near an upstream end of said central duct;

(c) at least one long vane extending outwardly from said central duct and generally spirally downstream along said central duct, and extending upstream of said upstream end of said central duct and attaching to said support pipe; and (d) at least one short vane extending outwardly from said central duct, said short vane forming an intersection with said long vane and therefrom extending downstream divergently from said long vane;

said at least one short vane and long vane for dividing the outer flow into at least two outer streams separated by at least one recirculation zone and directing the outer streams to flow spirally around the central stream.

14. The spreader as in claim 13 wherein said upstream end of said central duct has an inside diameter and said support pipe has a downstream end which is spaced a distance of from about zero to about one central-duct inside diameter upstream of said upstream end of said central duct.

15. The spreader as in claim 13 wherein said downstream end of said support pipe has attached thereto a centerbody.

16. A spreader for spreading a flow of air and pulverized coal into streams for staged combustion, said spreader comprising:

(a) a central duct;

(b) at least one vane extending outwardly from said central duct for dividing said air and pulverized coal flow into at least two streams and for causing said at least two streams to flow around said central duct; and (c) a contraction of cross section for air and pulverized coal flow upstream of said central duct for concentrating pulverized coal towards inner annuli of the air and pulverized coal flow.

17. The spreader as in claim 16 wherein said central duct is for dividing a flow of air and pulverized coal into a central stream within said central duct and into an outer flow surrounding said central duct; said at least one vane comprises at least one long vane extending generally spirally downstream along said central duct and at least one short vane forming an intersection with said long vane and therefrom extending downstream divergently from said long vane; and said at least one short vane and long vane are for dividing the outer flow into at least two outer streams separated by at least one recirculation zone and directing the outer streams to flow spirally around the central stream.

18. A method of spreading a flow of air and pulverized coal into streams for staged combustion, said method comprising:

(a) swirling the air and pulverized coal flow to concentrate pulverized coal towards outer annuli of the air and pulverized coal flow;

(b) dividing the flow of air and pulverized coal into a central stream and a surrounding outerflow;

(c) dividing said outer flow into at least two outer streams separated by recirculation zones; and (d) causing said at least two outer streams to flow spirally around said central stream.

19. A method of spreading a flow of air and pulverized coal into streams for staged combustion, said method comprising:

(a) contracting the cross section of air and pulverized coal flow to concentrate pulverized coal towards inner annuli of the air and pulverized coal flow;

(b) dividing the flow of air and pulverized coal into a central stream and a surrounding outerflow;

(c) dividing said outer flow into at least two outer streams separated by recirculation zones; and (d) causing said at least two outer streams to flow spirally around said central stream.

20. The method of claim 19 further comprising:

(e) providing a bypass flow of air and pulverized coal around said outer flow.

* * * * *